US007094003B2

(12) United States Patent
Faires et al.

(10) Patent No.: US 7,094,003 B2
(45) Date of Patent: Aug. 22, 2006

(54) BRACKET ASSEMBLY FOR LIFTING AND SUPPORTING A FOUNDATION

(75) Inventors: Guy L. Faires, Memphis, TN (US); James E. Jacobs, Germantown, TN (US); Stanley C. Garton, Pinson, AL (US)

(73) Assignee: Dixie Electrical Manufacturing Company, Memphis, TN (US)

( * ) Notice: Subject to any disclaimer, the term of this patent is extended or adjusted under 35 U.S.C. 154(b) by 0 days.

(21) Appl. No.: 11/089,865

(22) Filed: Mar. 25, 2005

(65) Prior Publication Data

US 2005/0214076 A1 Sep. 29, 2005

Related U.S. Application Data

(60) Provisional application No. 60/556,540, filed on Mar. 26, 2004.

(51) Int. Cl.
*E02D 5/00* (2006.01)
*E02D 5/74* (2006.01)
*E02D 27/50* (2006.01)

(52) U.S. Cl. ..... 405/230; 405/231; 405/244

(58) Field of Classification Search ..... 405/229–232, 405/244

See application file for complete search history.

(56) References Cited

U.S. PATENT DOCUMENTS 3,902,326 A 9/1975 Langenbach, Jr.
4,068,445 A 1/1978 Bobbitt
4,634,319 A 1/1987 May
4,673,315 A * 6/1987 Shaw et al. ..... 405/230
4,765,777 A * 8/1988 Gregory ..... 405/229
4,854,782 A 8/1989 May
4,911,580 A 3/1990 Gregory et al.
5,011,336 A 4/1991 Hamilton et al.
5,013,190 A * 5/1991 Green ..... 405/230
5,018,905 A * 5/1991 Kinder ..... 405/230
5,066,168 A 11/1991 Holderman
5,116,355 A 5/1992 Freeman, III
5,120,163 A * 6/1992 Holdeman et al. ..... 405/230
5,139,368 A 8/1992 Hamilton
5,154,539 A 10/1992 McCown, Sr. et al.
5,171,107 A 12/1992 Hamilton
5,213,448 A 5/1993 Seider et al.
5,217,325 A 6/1993 Freeman, III
5,234,287 A * 8/1993 Rippe, Jr. ..... 405/230
5,246,311 A * 9/1993 West et al. ..... 405/230
5,253,958 A * 10/1993 Bellemare ..... 405/232

(Continued)

FOREIGN PATENT DOCUMENTS

GB 2190693 * 11/1987

*Primary Examiner*—Jong-Suk (James) Lee
(74) *Attorney, Agent, or Firm*—Paul M Denk

(57) ABSTRACT

A bracket assembly rests upon a pier set adjacent to a foundation and a secondary component elevates the bracket assembly. The bracket provides adjustable engagement to limit rotation of the bracket with respect to an installed pier. The bracket assembly has an housing, a bearing member, load transfer plates, reinforcing means, and an adjusting bolt beneath the bearing member. The housing is either two parallel plates or a tube. In the plates embodiment, two slots receive either a pin, a gate alone, or a gate with a moveable plate. In the tube embodiment, the pier fits snugly within the tube. Further, the bracket permits locating tools over the piers to reduce induced bending moment at the junction of the pier and the bracket. The bracket assembly stabilizes and lifts piers.

18 Claims, 10 Drawing Sheets

U.S. PATENT DOCUMENTS 5,269,630 A 12/1993 Bolin et al.
5,336,021 A 8/1994 Freeman, III
5,433,556 A 7/1995 Freeman, III
5,575,591 A * 11/1996 Vanderklaauw ..... 405/230
5,711,504 A 1/1998 Cusimano
5,722,798 A 3/1998 Gregory
6,079,905 A * 6/2000 Ruiz et al. ..... 405/229
6,142,710 A * 11/2000 Holland et al. ..... 405/230
6,152,654 A 11/2000 Ruiz et al.
6,503,024 B1 * 1/2003 Rupiper ..... 405/229

* cited by examiner

BRACKET ASSEMBLY FOR LIFTING AND SUPPORTING A FOUNDATION

CROSS REFERENCE TO RELATED APPLICATION

This non provisional patent application claims priority to the provisional patent application having Ser. No. 60/556,540, which was filed on Mar. 26, 2004.

BACKGROUND OF THE INVENTION

The bracket assembly for lifting and supporting a foundation relates to L shaped foundation brackets in general and more specifically to improvements in the connections of the bracket to a pier for supporting a foundation. A unique aspect of the present bracket assembly is a removable gate and adjustable bolt that position the bracket assembly upon a pier to resist moment, translation, and rotation of a bracket.

The bracket assembly transfers the weight, or load, supported by a foundation, or footing, to a pier, pile or deeper foundation. The bracket assembly commonly cradles a footing, or foundation wall, of a structure, or building, then transfers the load to a pile or pier that bears on bedrock or other load bearing strata beneath the existing foundation. The main concept of this invention is to support a settling foundation Prior art designs have previously supported failed or shallow footings.

Piers made of concrete, reinforced concrete, timber, steel pipe, steel tubing, and solid steel bar bent into a helix have seen use at many sites to remedy failing foundations with varying success. The adequate transfer of the load from the foundation to the pier concerns contractors, engineers, and owners alike. Commonly, contractors place piers below a foundation by jack-hammering through a foundation, often through a basement floor. Piers directly below a foundation become impractical because of overhead height constraints and damage to an existing structure. To minimize risk, contractors excavate wider access holes lest, piers become too short. Short piers have proven cumbersome and time consuming for contractors and result in a pier of questionable flexural rigidity.

The present art overcomes the limitations of the prior art where a need exists for a bracket to adequately transfer the foundation load to a pier located adjacent to a foundation. That is, the art of the present invention, a bracket assembly for lifting and supporting a foundation, fixes a bracket to a pier with minimal moment and rotation of the bracket when under load. As a key feature, the bracket assembly reduces the distance between the pier and the foundation to minimize the moment induced into the top of a pier by an eccentric load from the foundation. The moment imparts bending upon the pier where the pier has the lowest lateral support from adjacent soil and tends to rotate a bracket away from the corner of the foundation. The rotation educes the effective bearing area between the bracket and the foundation. The gap exposed by a rotated bracket gives the appearance of a weak connection.

The difficulty in providing a bracket assembly is shown by prior art bracket designs that transferred a foundation load to a particular style of pier. In U.S. Pat. No. 5,120,163 to Holdeman et al., U.S. Pat. No. to 5,171,107 to Hamilton et al., and U.S. Pat. No. 5,246,311 to West et al. each describe a bracket for a specific style or size of a pier. Some prior bracket designs state a feature to accommodate different sizes and styles of piers but, only provide for partial front to rear engagement between the installed pier and a bracket.

Typically, an installed pier has a clearance between the lower portions of the bracket and the front edge of a pier toward the foundation.

In U.S. Pat. No. 6,079,905 to Ruiz et al. for example, the adjustable brackets only engage the upper portion of the bracket and the back edge of an installed pier farthest from the foundation. The prior art brackets provide little means of contact between the lower portion of the bracket and the front edge of a pier towards a foundation. Under typical loads without contact at both the lower front and the upper rear edges of the pier, the prior art brackets rotate about an axis perpendicular to the length of a pier. Rotation causes the foundation support portion of a bracket to disengage from a foundation opening a gap, thus reducing the effective load capacity of a bracket. Contractors and owners alike desire a bracket assembly adaptable for various shapes and sizes of piers and adjustable to prevent rotation and moment between a bracket and a pier. Thus, the present invention has the ability to fully support the foundation upon the bracket, to maintain such, and to prevent slippage between the bracket and the supported foundation.

SUMMARY OF THE INVENTION

Accordingly, the present invention improves existing brackets so that the bracket accommodates stabilization and lifting piers of various sizes ranging from about one inch to about four inches in diameter and various shapes such as round, square, and polygonal. Simultaneously, the present invention provides engagement to limit rotation or shifting of the bracket with respect to an installed pier. A removable gate, or pin, feature allows the contractor to install the bracket upon the foundation either before or after placement of a pier. The present invention also allows a contractor to use multiple systems for placement of a pier such as rotational torque drive and direct resistance drive among others. The present invention maintains placement and orientation of a pier to resist rotation and slippage. Further, the present invention permits locating installation tools and components over the center of the piers to reduce induced bending moment at the junction of a pier and a bracket, particularly where the foundation rest thereon.

A bracket assembly has a structural bearing angle member, a housing of two parallel plates, a pier guide, two load transfer plates, a locking bolt plate and two threaded support bolts, and a jack. This minimum configuration places the bracket assembly upon a pier directly below a failing, or settling, foundation in need of repair. A secondary component includes a lifting plate and a temporary jack coupling strap member and the secondary component can function with a pier offset from a foundation.

In the present invention, the structural bearing angle member supports and lifts the foundation relative to the pier kept between two parallel plates. The pier guide provides a moveable stop on the front edge of the pier nearest the foundation. In addition, the pier guide also provides a pin to engage the rear edge of the pier to prevent the pier from shifting out of the bracket. Alternatively, the pier guide has a gate with a moveable plate or a tube shape. The moveable stop eliminates any gap, front to back, between the front edge of an installed pier and the lower portion of the bracket assembly.

Therefore, it is an object of the invention to provide contact and direct load transfer between the bracket and the front edge of piers having various shapes and sizes.

It is a further object of the present invention to prevent shifting and rotation of the bracket with respect to a pier particularly when subjected to the weight of the foundation.

It is a still further object of the present invention to eliminate movement of a bracket away from a foundation.

It is an even still further object of the present invention to prevent disengagement of a bracket from the bottom of a foundation.

These and other objects may become more apparent to those skilled in the art upon review of the invention as described herein, and upon undertaking a study of the description of its preferred embodiment, when viewed in conjunction with the drawings.

BRIEF DESCRIPTION OF THE DRAWINGS

The same reference numerals refer to the same parts throughout the various figures.

DESCRIPTION OF THE PREFERRED EMBODIMENT

Figure 1:
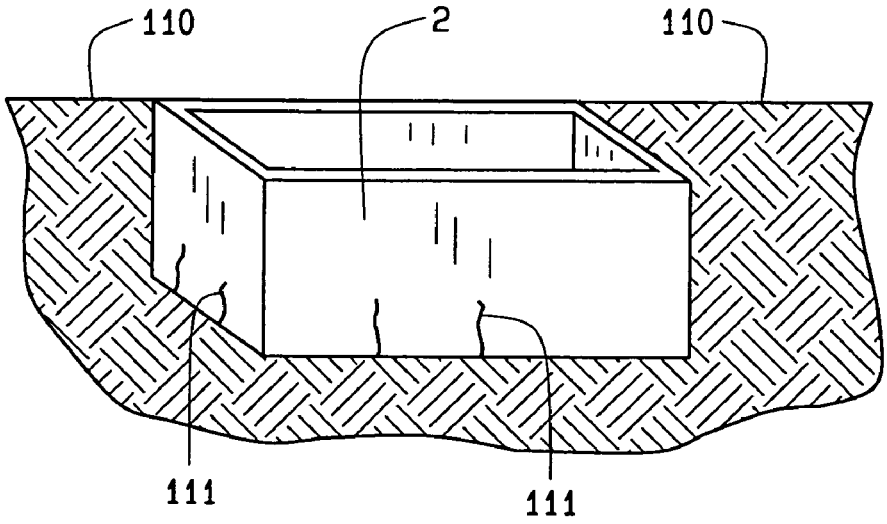
FIG. 1 shows an isometric view of a foundation in distress.
Figure 2:
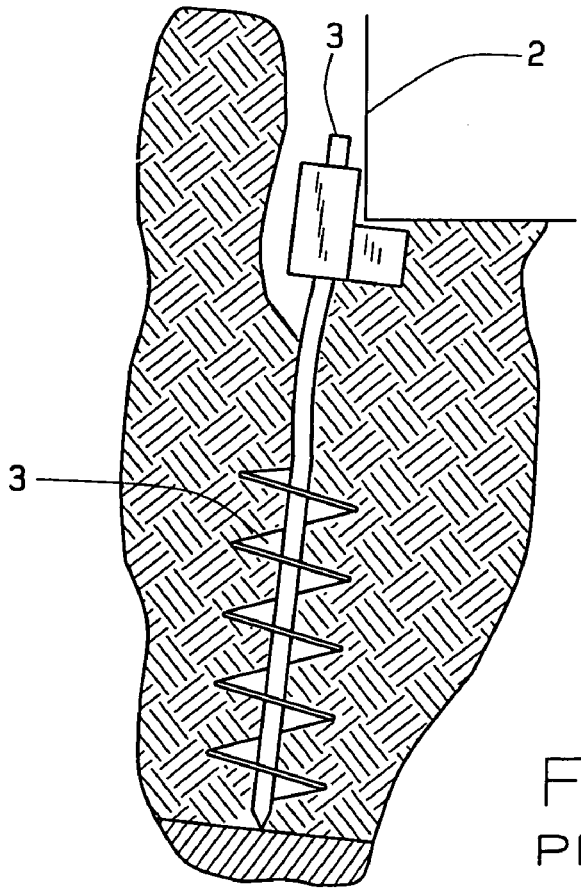
FIG. 2 PRIOR ART
FIG. 2 shows a side view of the prior art bracket that tends to shift off a foundation and deflect a pier.

The present art overcomes the prior art limitations by providing a bracket assembly that lifts and supports a foundation with adjustable lifting and pier positioning hardware, that transfers foundation loads to piers of various shapes and sizes, and that does not induce rotation of the bracket upon a pier. Turning to FIG. 1, soil settles in the vicinity of a foundation 2. A foundation 2 extends beneath the ground surface 110, one or more stories, at least ten feet, and supports a structure above the foundation 2. After enough settlement, a foundation 2 will move out of alignment and likely crack 111 then leak. To remedy a distressed, or settling, foundation 2, building owners and contractors have turned to piers 3 like in the prior art shown in FIG. 2. A pier 3 extends from the foundation 2 to bedrock or has sufficient length of embedment to resist foundation loads. The pier 3 has a generally linear shape with a shank. The shank may have a helical shape to increase load capacity. Piers 3 have a variety of cross sections ranging from square to polygonal in both hollow and solid forms. In the prior art, the pier 3 is located away and at an angle from the foundation to permit installation of the pier 3. In FIGS. 1–14, the pier 3 will have a square cross section though the present invention 1 will accommodate other shapes. Also in FIGS. 1–14, front refers to the direction towards and location nearest the foundation 2 and upper or top refers to the direction and location above a pier 3. Opposite the shank, a prior art bracket rests near the top of the pier 3. The prior art bracket has a generally L shape reinforced for multiple ton loads. The prior art bracket bears a portion of the weight of the foundation load as it contacts the foundation 2. Due to soil conditions and installation methods, the prior art bracket creates an angle between the bracket and the foundation. The foundation has a tendency to slip off the prior art bracket and the pier 3 tends to deflect as the prior art bracket rotates.

Figure 3A:
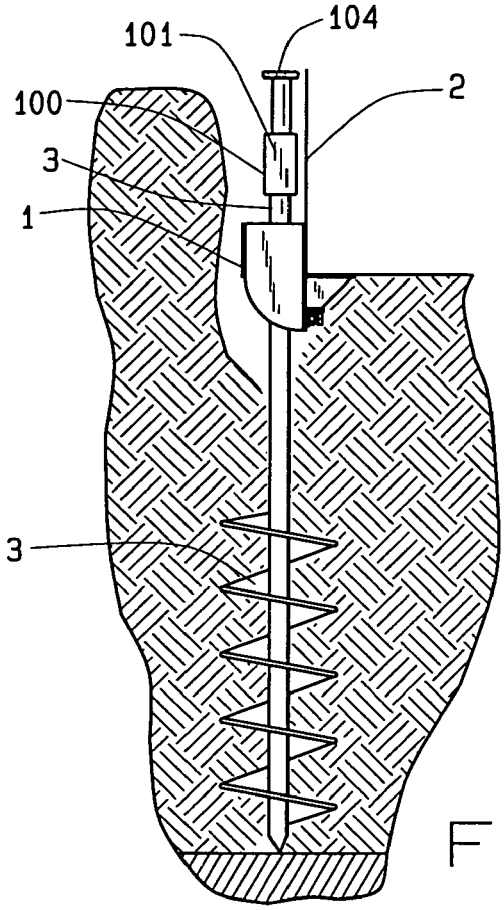
FIG. 3A illustrates a side view of the preferred embodiment of the bracket assembly constructed in accordance with the principles of the present invention and with jacking mechanism in operation.

Moving to FIG. 3A, a secondary component 100 atop the pier 3 forces the bracket assembly 1 to approach the foundation 2 and bear foundation loads. In the present invention 1, the pier 3 is installed adjacent and close to the foundation 2. The bracket assembly 1 installs upon a pier 3 in close quarters at a bottom corner of a foundation 2. The secondary component 100 has a jack 101 upon a locking plate 102 upon the pier 3. Cranking of the jack 101 extends the cylinder 103 to a header 104 and raises the header 104. The header 104 has straps 105 upon either end (not shown) that reach to the bracket assembly 1. Raising the header 104 raises the bracket assembly 1 and supports the foundation 2.

Figure 3B:
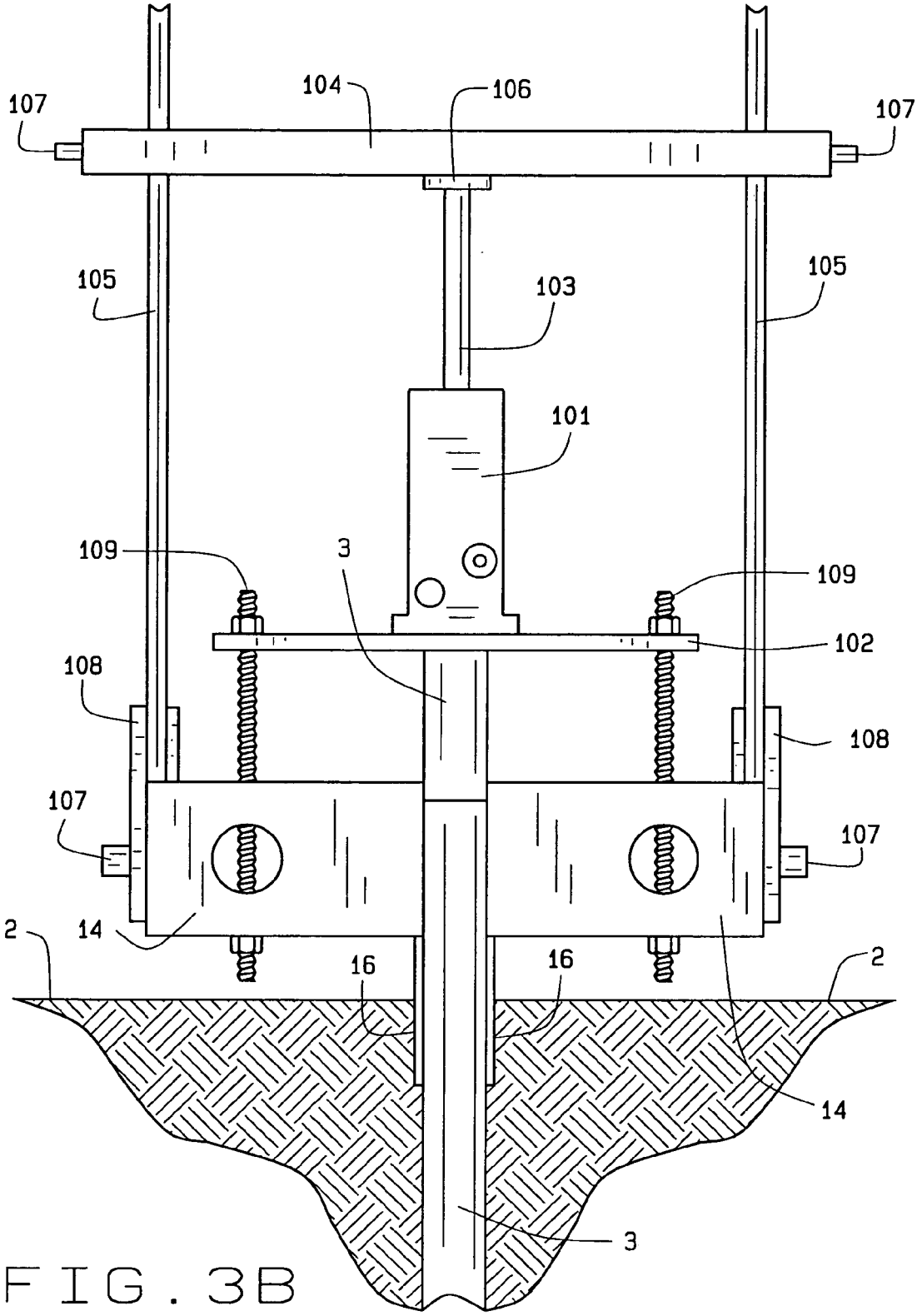
FIG. 3B illustrates a back view of the bracket assembly with jacking mechanism in operation, where extension of the jack lifts the bracket closer to the top of the pier.

Turning to FIG. 3B a back view of the secondary component 100 illustrates the bracket assembly 1 in operation. Upon the top of a pier 3, a locking plate 102 rests, generally centered. A jack 101 rests upon the locking plate 102 and the cylinder 103 of the jack 101 extends upward to a header plate 106. The header plate 106 is generally rectangular. The header plate 106 transmits the force from the cylinder 103 over a broader area of the header 104. The generally rectangular header 104 spans the width of the bracket assembly 1 and has two opposite ends. At each header end, a strap 105 joins the header 104 with a strap pin 107 for a connection. The strap 105 has a generally thin rectangular cross section like typical flat bar stock, much greater length than the width of the header 104, and multiple spaced holes (not shown) along its length to accommodate different initial heights between the locking plate 102 and the header 104 prior to cranking the jack 101.

The straps 105 descend towards the bracket assembly 1 and terminate in U shaped devises 108. Two sections of material joined to an end of the strap 105 form the clevis 108. In the preferred embodiment, the strap 105 and the clevis 108 are made of flat steel. Each section of the clevis 108 has a central hole that aligns over a hole in the load transfer plates 12 of the bracket assembly 1. The load transfer plates 12 are parallel to the clevis and fit between the clevis sections 108. A strap pin 107 secures the clevis to the load transfer plates 12. Perpendicular to the load transfer plate 12, a bottom plate 13 (not shown in this view) upon the bracket assembly 1 has a centered hole to receive a support bolt 109 secured by a nut beneath the bottom plate 13. The support bolt 109 extends from the bottom plate 13 through the locking plate 102 to another nut connection. Perpendicular to the load transfer plates 12 and the bottom plates 13 the back plates 14 extend from the load transfer plates 12 to the centrally located plates 16. Between the plates 16, a pin 19, see FIG. 5, restrains the pier 3 from moving front to back within the bracket assembly 1. The secondary component 100 is symmetrical with straps 105 and devises 108 upon both sides of a bracket assembly 1.

Cranking the jack 101 raises the header 104 which pulls up the devises 108, load transfer plates 12, and bottom plates 13. When the bracket assembly 1 reaches its final position and the foundation 2 has become level and repaired, the nuts are advanced upon the support bolts 109 to close upon the bottom plates 13. The contractor then removes the secondary component 100 and fills in the excavation upon a bracket assembly 1.

Figure 4:
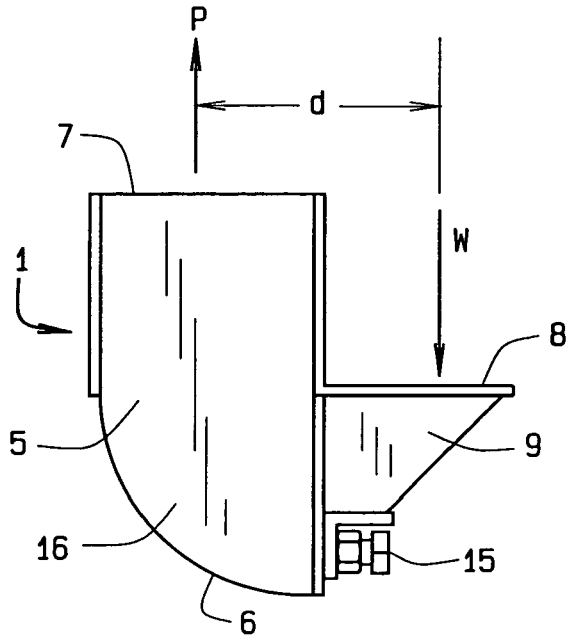
FIG. 4 describes the forces upon of the bracket assembly with improvements to counteract the moment applied to the pier and bracket assembly.

Back to FIG. 4, while cranking the jack 101, the bracket assembly 1 withstands a portion of the foundation load, W and the corresponding reaction force, P. The foundation load and the reaction force are spaced apart a distance, d. Though in balance, the foundation load and the reaction force cause a moment upon the bracket assembly 1. The moment and resulting couple force tend to rotate the bracket assembly 1 away from the underside of the foundation 2, forming an angle. In this view, the bracket assembly 1 has a housing 5 for the pier 3 such as a pair of plates 16, generally rectangular in shape with two ends: a first end denoting the lower end and a second opposite end denoting the upper end. The first end 6 has a generally quarter circle or arcuate shape and the opposite second end 7 has a horizontal, flat, or squared shape. The first end 6 denotes the bottom of the bracket assembly 1. A bearing member 8 such as an angle attaches to the plate 16, centered upon the spaced apart plates 16. Opposite the bearing angle 8, a pier guide spans between the plates 16 at the back of the bracket assembly 1. The pier guide and the bearing angle 8 co-operate to minimize translation of the bracket assembly 1 upon the pier 3. Beneath the bearing angle 8, an adjusting bolt 15 has a longitudinal axis parallel to a leg of the bearing angle 8. The adjusting bolt 15 is centered between the plates 16 and proximate to the first ends 6 of the plates 16. The adjusting bolt 15 passes between the plates 16 and contacts the pier 3. The adjusting bolt 15 and the pier guide co-operate to minimize moment applied to the top of the pier 3 and rotation of the bracket assembly 1.

Figure 5:
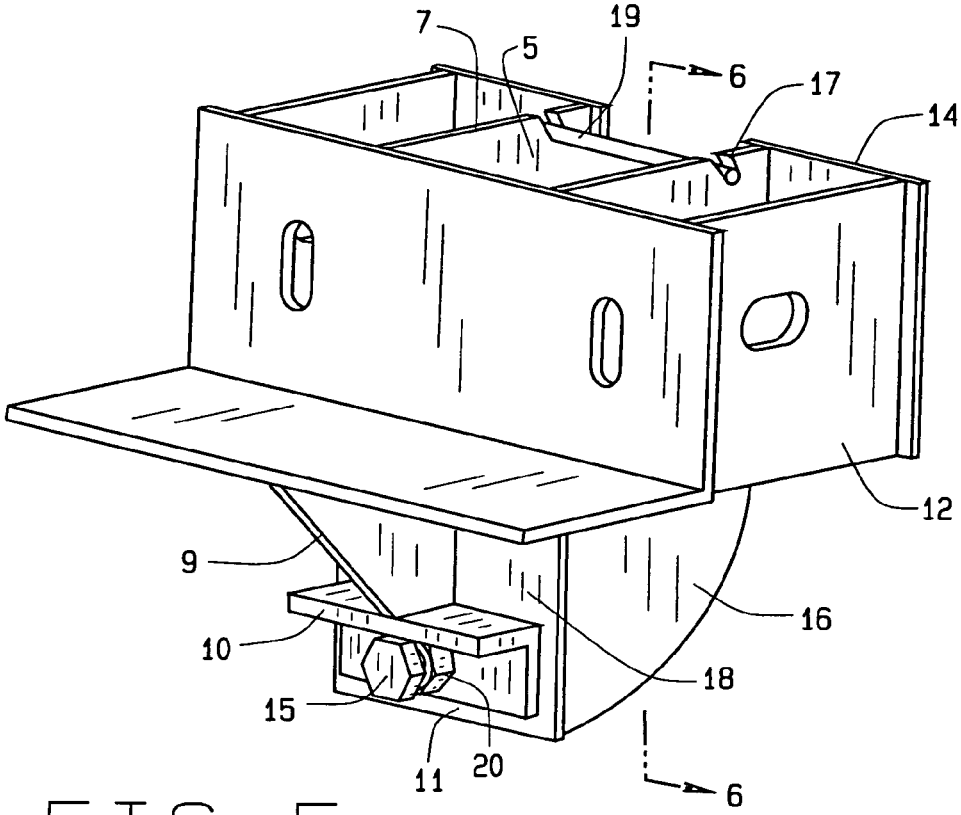
FIG. 5 shows an isometric view of the preferred embodiment of the bracket assembly with a pin in slots and an adjustable bolt perpendicular to the pin to contain a pier.

The preferred embodiment of the bracket assembly 1 appears in FIG. 5. The bracket assembly 1 begins with a housing 5 of two parallel and spaced apart plates 16. A plate 16 has a generally rectangular shape with two ends. The first end 6 has a quarter circle or arcuate shape when viewed from the side of the bracket assembly 1 and the opposite second end 7 has a horizontal or square shape denoting the top of the bracket assembly 1. A bearing angle 8 spans across the plates 16 in an L shaped cross section with the vertex of the L shape generally at the center of the present invention. Centered beneath the bearing angle 8, a gusset 9 depends to a lower plate 18. The gusset 9 has a planar shape generally triangular and parallel to the plates 16. The gusset 9 joins, often by welding, to the bearing angle 8, the lower plate 18, and the angle 10. The lower plate 18 spans between the plates 16 beneath the bearing angle 8 to the first ends 6. Beneath the gusset 9, an angle 10 is provided to stiffen the lower plate 18. The angle 10 has a generally L shaped cross section with the vertex of the L shape towards the center of the present invention. The angle 10 generally parallels the bearing angle 8. A means to receive a bolt 11, such as a nut centered upon the angle 10, receives an adjusting bolt 15. The adjusting bolt 15 is threaded and has a head. To stabilize the bracket assembly 1 upon the pier 3, the adjusting bolt 15 threads through the nut and passes through both the angle 10 and the lower plate 18 generally centered between the plates 16. The adjusting bolt contacts the pier 3 (not shown).

Spaced apart from and parallel to the plates 16, a pair of load transfer plates 12 extends perpendicular to the bearing angle 8 at the sides of the bracket assembly 1. The load transfer plates 12 have holes generally in the center to receive a pin 107 from the strap 105. Spanning across the plates 16 near the second end 7 and the load transfer plates 12, reinforcing means 14 stiffen the bracket assembly 1 such as back plates 14 parallel to the bearing angle 8. Perpendicular to the bearing angle 8, the load transfer plates 12, and the back plates 14, the bottom plates 13 (see FIG. 7) permit passage of the support bolts 109 and secure nuts to lift the bracket assembly 1 during use as described in FIG. 3B.

Returning to the plates 16 near the second end 7, the plates 16 have slots 17 generally along the length of the pier 3. Serving as a pier guide, a pin 19 rests within the slots 17 of the two plates 16. A slot 17 has a somewhat vertical orientation, rounded bottom, and a mouth wider than the diameter of a pin 19. The slot 17 tilts towards the rear of the present invention 1. As the present invention 1 advances upward, the slots 17 bind the pin 19 against the pier 3. Alternatively, the slots 17 have a generally L shape to contain the pin 19 upon the pier 3. The pin 19 has a generally cylindrical shape and may or may not be threaded for securement by nuts. The pin 19 co-operates with the bearing angle 8 to secure the pier 3 from moving front to back within the bracket assembly 1.

Figure 6:
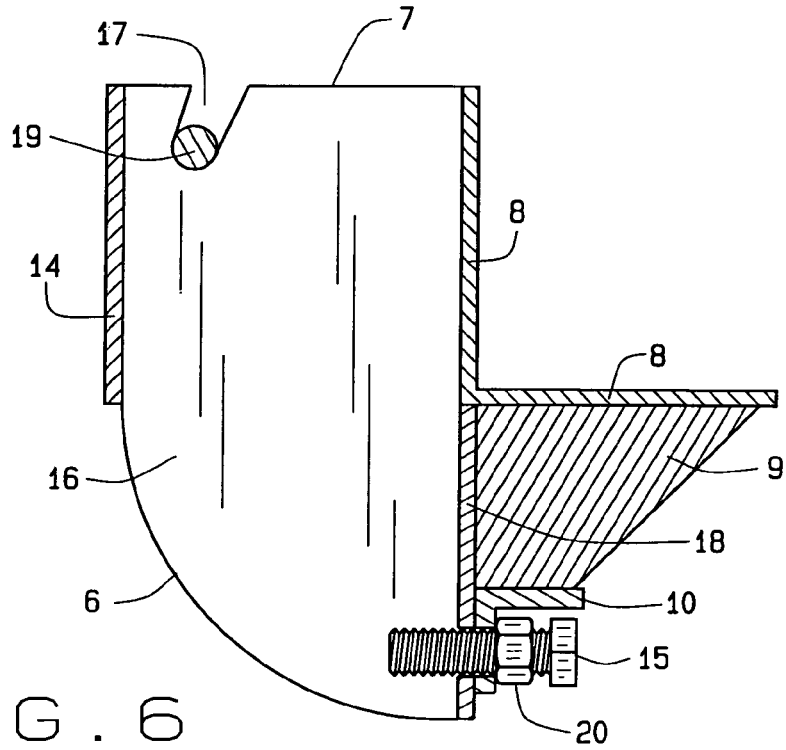
FIG. 6 shows a side view of the preferred embodiment of the bracket assembly with a pin in a slots and an adjustable bolt.

Turning to FIG. 6, a plate 16 has a generally rectangular shape with the first end 6 shaped as a quarter circle or other arcuate form and the opposite second end 7 generally square cut or horizontal. The second end 7 has a slot 17 proximate to the back for receiving the pin 19. The plate 16 is perpendicular to and between the bearing angle 8 and the back plate 14. The vertex of the bearing angle 8 is generally at the midpoint of the plate 16. A lower plate 18 spans across the plates 16 co-planar with one leg of the bearing angle 8. An angle 10 joins the lower plate 18 proximate to the second end 7 of the plate 16 and parallels the bearing angle 8. A nut 20 attached to the angle 10 admits the adjusting bolt 15. The adjusting bolt 15 has a head upon one end and opposite the head, the adjusting bolt 15 contacts the pier 3 (not shown).

The gusset 9 has a truncated triangular plate shape and extends from the angle 10 to a leg of the bearing angle 8. The gusset 9 is generally centered between the plates 16 and joined to the bearing angle 8, the lower plate 18, and the angle 10, often by welding. Opposite the bearing angle 8, a back plate spans between a plate 16 and a load transfer plate 12 (not shown) near the first end 6.

Figure 7:
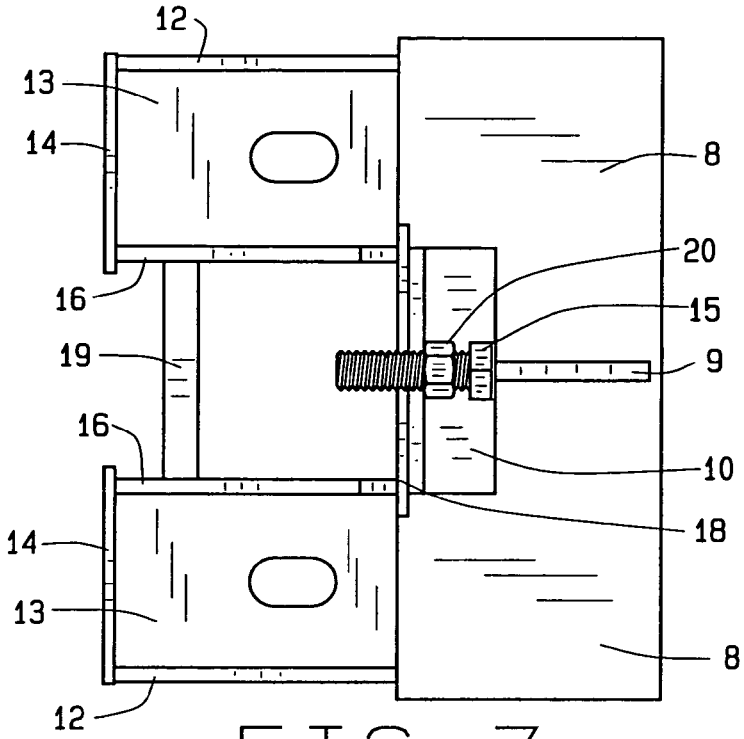
FIG. 7 describes a bottom view of the preferred embodiment of the bracket assembly where the pin and the adjustable bolt prevent translation and rotation of the pier.

Rotating to FIG. 7, the bracket assembly 1 has a symmetric construction that contains a pier 3 between the pin 19 and the adjusting bolt 15. The cylindrical pin 19 spans between the parallel and spaced apart plates 16 here shown on edge. Back plates 14 join perpendicular to the plates 16 and towards the top of the present invention 1. Load transfer plates 12 join perpendicular to the back plates 14 and parallel and spaced apart to the plates 16. The bearing angle 8 joins to both the load transfer plates 12 and the plates 16. Bottom plates 13 then join between the load transfer plates 12 and the plates 16, and the back plates 14 and the bearing angle 8. The bottom plates 13 have a generally centered hole to admit a support bolt 109 (not shown but see FIG. 3B).

The bearing angle 8 has a generally centered gusset 9 here shown on edge. The gusset 9 extends down and away from the bearing angle 8 to the angle 10. The angle 10 has an L shaped cross section with one leg of the angle 10 joining the gusset 9 and the other leg of the angle 10 joining the lower plate 18. The lower plate 18 spans across the plates 16 beneath the bearing angle 8. The lower plate 18 and the other leg of the angle 10 have coaxial holes to admit the adjusting bolt 15. A nut 20 secures the adjusting bolt 15 to the bracket assembly 1. The adjusting bolt 15 and pin 19 in contact with the pier 3 minimize front to back movement and rotation of the bracket assembly 1 upon the top of the pier 3.

Figure 8:
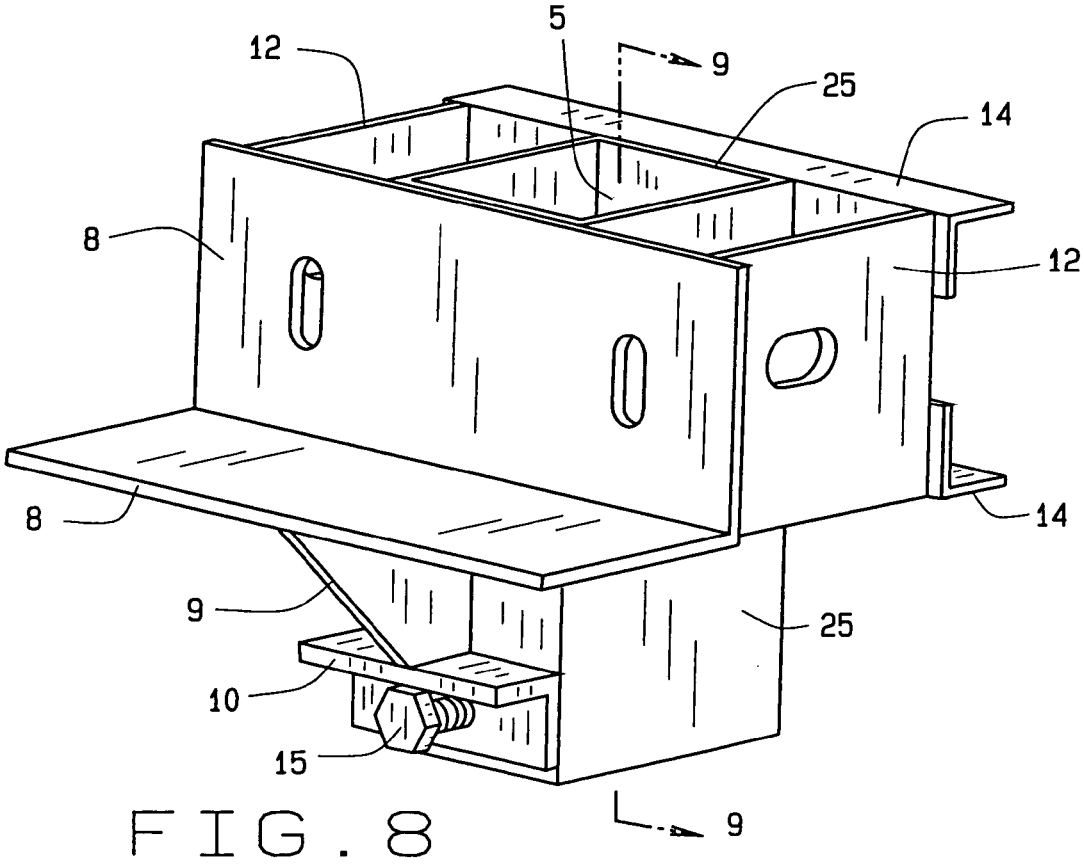
FIG. 8 shows an isometric view of a second embodiment of the bracket assembly with a reinforced tube and an adjustable bolt to bias against a pier.

A second embodiment of the bracket assembly 1 appears in FIG. 8. The bracket assembly 1 begins with a hollow tube 25, generally square in cross section and oriented upright. Serving as a pier guide, the tube 25 fits the shape of the top of a pier 3. Those skilled in the art will recognize that a variety of shapes can be used in addition to the square shape of the tube 25 described. A bearing angle 8 spans across the tube 25 in an L shape cross section with the vertex of the L shape generally at the center of the present invention 1. The bearing angle 8 contacts the front of the tube 25. Centered beneath the bearing angle 8, a gusset 9 hangs downwards and joins to the front of the tube 25 as well. The gusset 9 has a planar shape generally triangular and perpendicular to a leg of the bearing angle 8 and to the tube 25. Beneath the gusset 9, an angle 10 spans the width of the tube 25. As before, the gusset 9 welds or joins to the bearing angle 8, the lower plate 18, and the angle 10. The angle 10 has an L shaped cross section with the vertex of the L shape towards the center of the present invention 1. The angle 10 generally parallels the bearing angle 8. A threaded hole 11 centered upon the angle 10 receives an adjusting bolt 15. The adjusting bolt 15 is threaded and has a head. To stabilize the bracket assembly 1 upon the pier 3, the adjusting bolt 15 threads through the hole 11, passes into the tube 25, and contacts the center of the pier 3 (not shown).

Spaced apart from and parallel to the tube 25, a pair of load transfer plates 12 extends perpendicular to the bearing angle 8 at the sides of the bracket assembly 1. The load transfer plates 12 have holes generally in the center to receive a pin 19 from the strap 105. Spanning across the tube 25 for the width of the bearing angle 8, reinforcing angles 14, or angle shaped members, parallel the bearing angle 8. The reinforcing angles 14 have an L shaped cross section with the vertex of the L at the corners of the load transfer plates 12. The reinforcing angles 14 are perpendicular to and join the load transfer plates 12 and join the back surface of the tube 25 opposite the bearing angle 8. The reinforcing angles 14 are spaced apart from each other. Perpendicular to the bearing angle 8, the load transfer plates 12, and the reinforcing angles 14, bottom plates 13 (see FIG. 10) permit passage of the support bolts 109 and secure nuts to lift the bracket assembly 1 during use as described in FIG. 3B.

Figure 9:
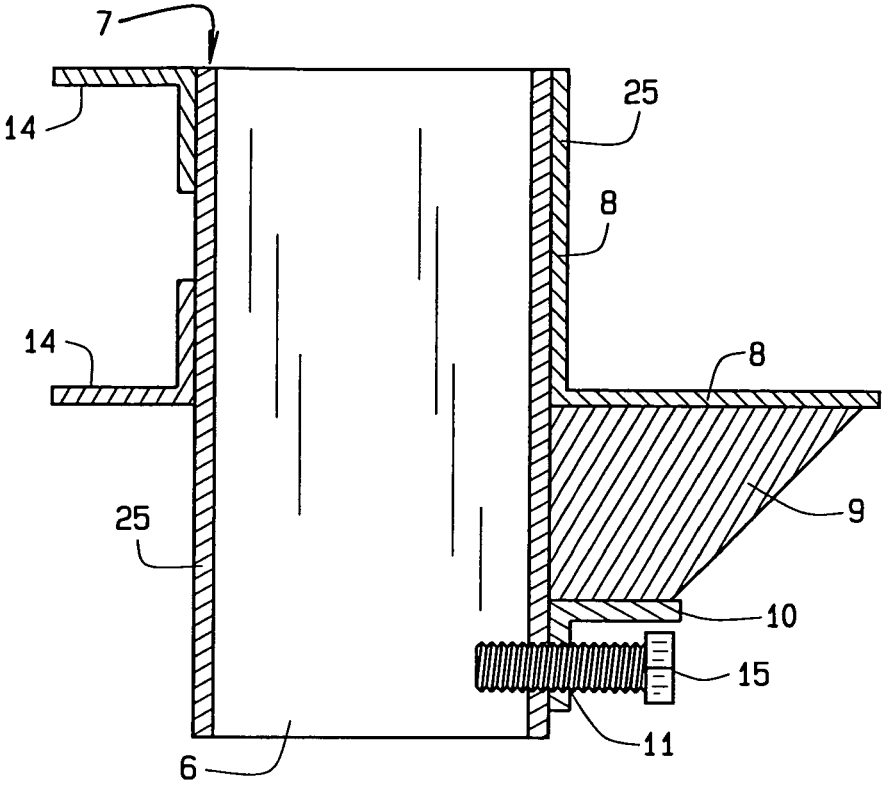
FIG. 9 shows a side view of the second embodiment of the bracket assembly with a reinforced tube and an adjustable bolt.

Turning to FIG. 9, a tube 25 has a generally rectangular shape with a first end 6 having the adjusting bolt 15 and a second end 7 opposite the first end 6. The first and the second ends 6, 7 have a horizontal or square cut on a plane perpendicular to the length of the tube 25. The vertex of the bearing angle 8 is generally at the midpoint of the tube 25. The angle 10 joins the tube 25 proximate to the first end 6 of the tube 25 and parallels the bearing angle 8. A threaded hole 11 centered upon the angle 10 admits the adjusting bolt 15. The adjusting bolt 15 has a head upon one end and opposite the head, the adjusting bolt 15 contacts the pier 3 (not shown). The gusset 9 has a truncated triangular plate shape and extends from the angle 10 to a leg of the bearing angle 8. The gusset 9 is generally centered upon the tube 25 and perpendicular to the tube 25. Welding joins the gusset 9 to the lower plate 18, the angle 10, and the bearing angle 8. Opposite the bearing angle 8, two reinforcing angles 14 span between the load transfer plates 12 (not shown) and the tube 25 near the second end 7. The reinforcing angles 14 form a generally split C shape with the vertices of the reinforcing angles towards the tube 25 and in the upper half of the tube 25.

Figure 10:
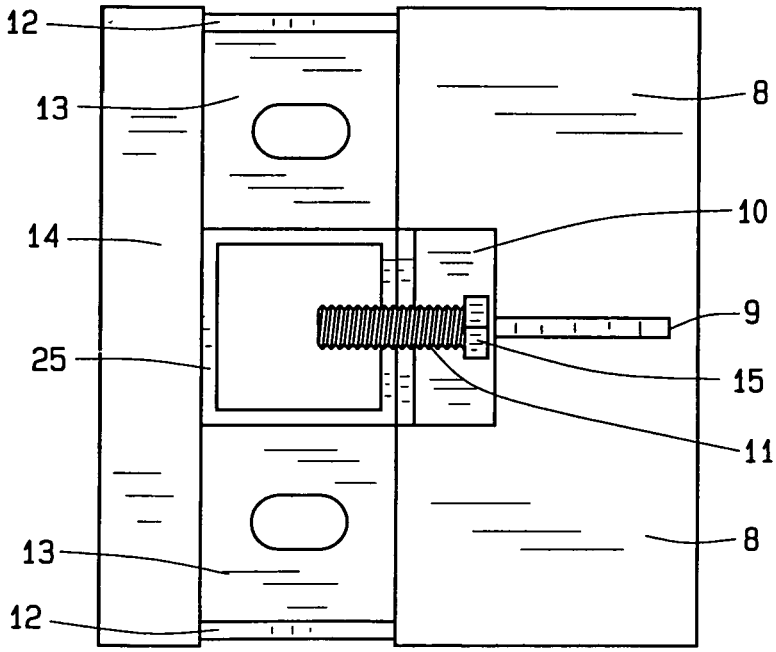
FIG. 10 describes a bottom view of the second embodiment of the bracket assembly where the tube and an adjustable bolt prevent translation of the pier.

Rotating to FIG. 10, the bracket assembly 1 has a symmetric construction that contains the pier 3 within the tube 25 and the adjusting bolt 15. The tube 25 has a shape to fit the top of a square pier 3. Reinforcing angles 14 join perpendicular to the tube 25 and towards the top half of the present invention 1. Load transfer plates 12 join perpendicular to the reinforcing angles 14 and parallel and spaced apart from the tube 25. The bearing angle 8 joins to both the load transfer plates 12 and the tube 25. Bottom plates 13 then join to the load transfer plates 12 and the tube 25, and the reinforcing angles 14 and the bearing angle 8. The bottom plates 13 have a generally centered hole to admit a support bolt 109 (not shown here but see FIG. 3B).

The bearing angle 8 has a generally centered gusset 9 here shown on edge. The gusset 9 extends down and away from the bearing angle 8 to the angle 10. The angle 10 has an L shaped cross section with one leg of the angle 10 joining the gusset 9 and the other leg of the angle 10 joining the tube. The bearing angle 8, the lower plate 18, and the angle 10 weld to the gusset 9. The angle 10 spans across the tube 25 beneath the bearing angle 8. The other leg of the angle 10 has a threaded hole 11 to admit the adjusting bolt 15. The adjusting bolt 15 in contact with the pier 3 minimizes front to back movement of the pier 3 within the tube 25 and rotation of the bracket assembly 1 upon the pier 3.

Figure 11:
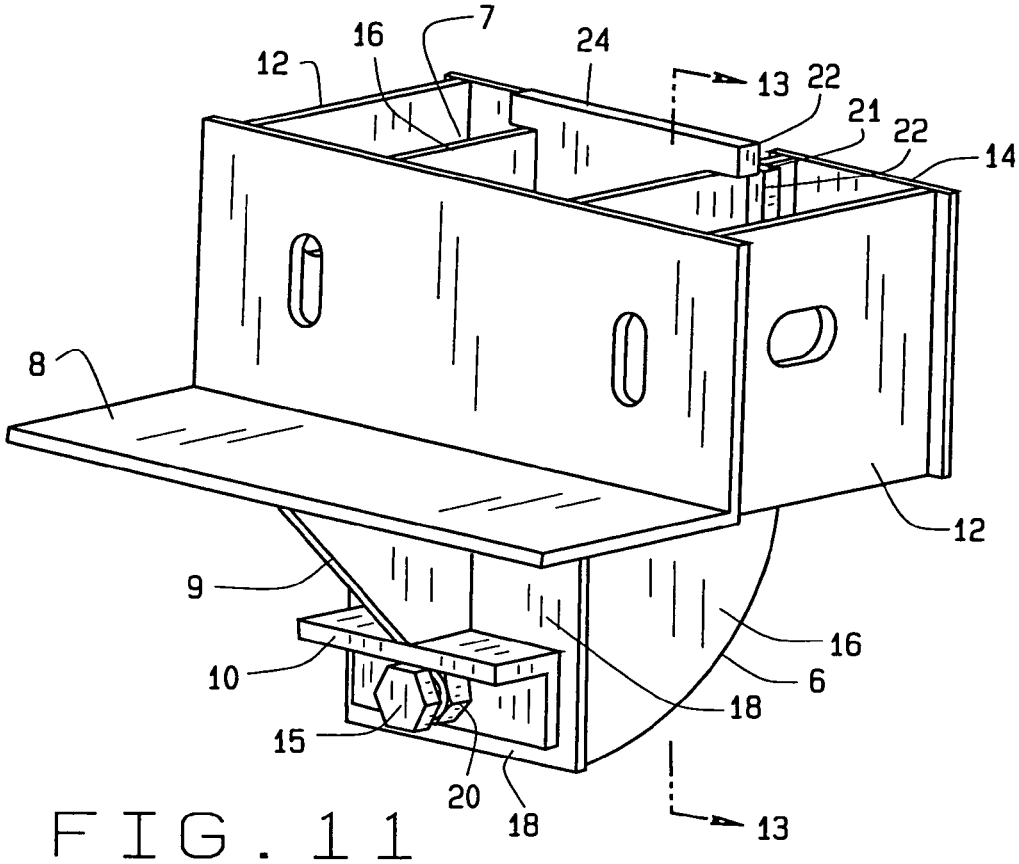
FIG. 11 shows an isometric view of a third embodiment of the bracket assembly with a moveable plate and an adjustable bolt to receive a pier.

A third embodiment of the bracket assembly 1 appears in FIG. 11. The bracket assembly 1 begins with two parallel and spaced apart plates 16. A plate 16 has a generally rectangular shape with two ends. The first end 6 has a quarter circle or arcuate shape when viewed from the side of the bracket assembly 1 and the opposite second end 7 has a horizontal or square shape denoting the top of the bracket assembly 1. A bearing angle 8 spans across the plates 16 in an L shaped cross section with the vertex of the L shape generally at the center of the present invention. Centered beneath the bearing angle 8, a gusset 9 depends to a lower plate 18. The gusset 9 has a planar shape generally triangular and parallel to the plates 16. The lower plate 18 spans between the plates 16 beneath the bearing angle 8 to the first ends 6. Beneath the gusset 9, an angle 10 spans across the lower plate 18. The gusset 9 joins by welding to the bearing angle 8, the lower plate 18, and the angle 10. The angle 10 has a generally L shaped cross section with the vertex of the L shape towards the center of the present invention 1. The angle 10 generally parallels the bearing angle 8. A nut 20 centered upon the angle 10 receives a first adjusting bolt 15. The first adjusting bolt 15 is threaded and has a head. To stabilize the bracket assembly 1 upon the pier 3, the first adjusting bolt 15 threads through the nut 20 and passes through both the angle 10 and the lower plate 18 generally centered between the plates 16. The first adjusting bolt 15 contacts the pier 3 (not shown).

Spaced apart from and parallel to the plates 16, a pair of load transfer plates 12 extends perpendicular to the bearing angle 8 at the sides of the bracket assembly 1. The load transfer plates 12 have holes generally in the center to receive a pin 107 from the strap 105. Spanning across the plates 16 near the second end 7 and the load transfer plates 12, back plates 14 parallel the bearing angle 8. Perpendicular to the bearing angle 8, the load transfer plates 12, and the back plates 14, the bottom plates 13 (see FIG. 14) permit passage of the support bolts 109 and secure nuts to lift the bracket assembly 1 during use as described in FIG. 3B.

Returning to the plates 16 near the second end 7, the plates 16 have slots 17 generally vertical in the direction of the pier 3 and proximate to the back plates 14. Serving as the pier guide, a gate 21 rests within the slots 17 of the two plates 16. The gate 21 has a flat rectangular shape with two collinear opposed ears 22 that extend through the generally vertical slots 17 and beyond the plates 16 towards the load transfer plates 12. Ahead of the gate 21 towards the front, a moveable plate 24 has a rectangular shape to fit within the plates 16 and two collinear opposed ears 22 to rest upon the top edge of the plates 16. The moveable plate 24 advances from the gate 21 towards the pier 3. The moveable plate 24 co-operates with the bearing angle 8 to secure the pier 3 from moving front to back within the bracket assembly 1.

Figure 12:
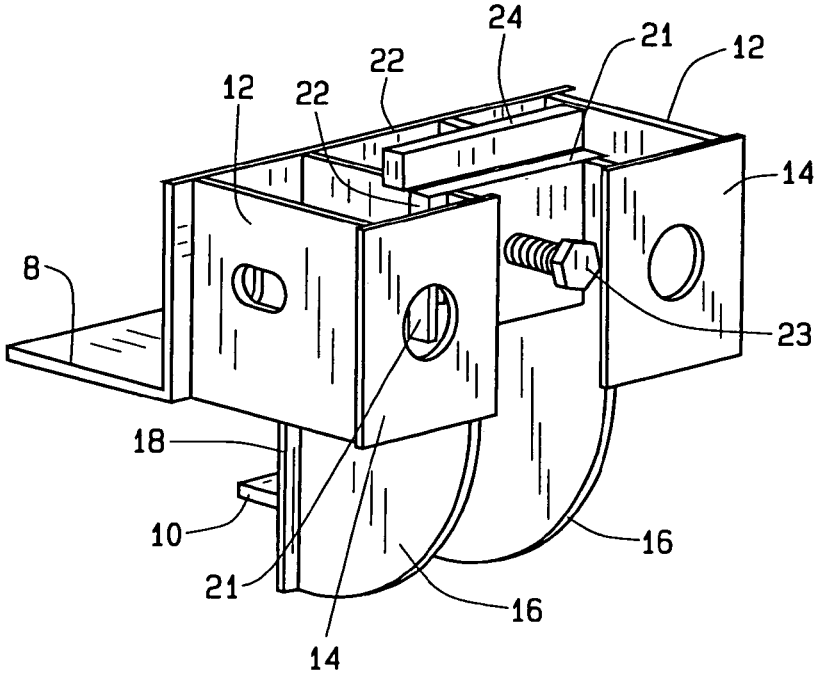
FIG. 12 shows an isometric view reversed of FIG. 11 of the third embodiment of the bracket assembly where a second adjusting bolt advances the moveable plate.

FIG. 12 illustrates the advancement of the moveable plate 24 from the gate 21 to the pier 3. The gate 21 has a centered threaded hole that admits a second adjusting bolt 23. The second adjusting bolt 23 has a head on one end and threads upon the shank opposite the head. The second adjusting bolt 23 enters the hole upon the gate 21 and advances through the gate 21 and contacts the moveable plate 24. The second adjusting bolt 23 bears generally upon the center of the moveable plate 24. In use, the gate 21 drops into the slots 17 of each plate 16 and the moveable plate 24 drops into the gap between the two plates 16 proximate to the pier 3. Turning of the second adjusting bolt 23 advances and retracts the moveable plate 24, from the gate 21 and the top of the pier 3.

Figure 13:
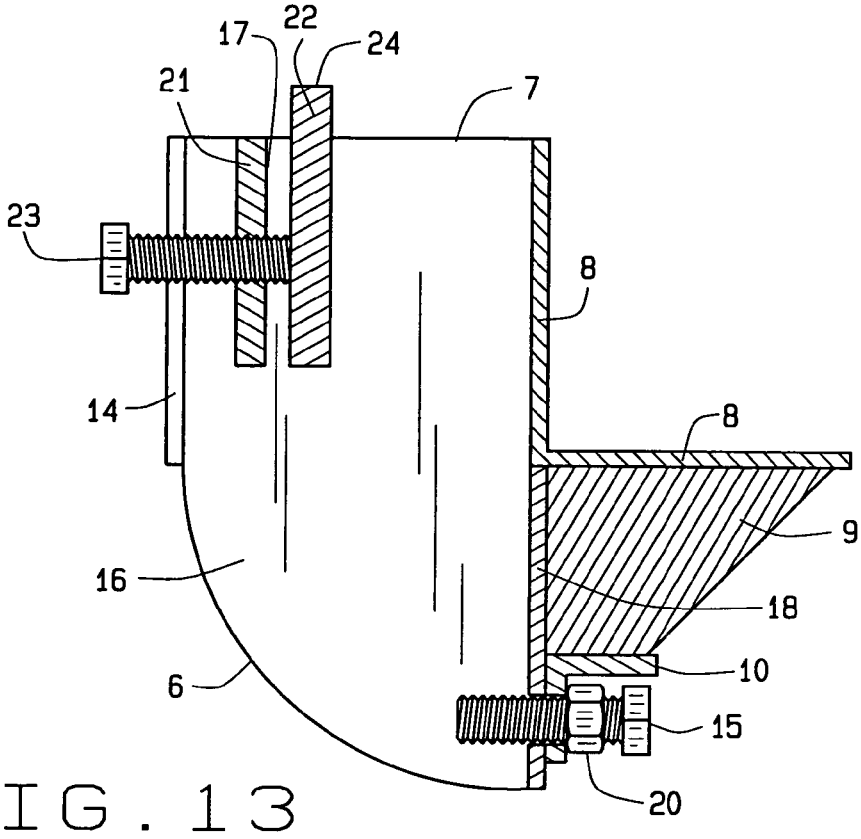
FIG. 13 shows a side view of the third embodiment of the bracket assembly where the second adjusting bolt secures to a fixed gate.

Turning to FIG. 13, a plate 16 has a generally rectangular shape with the first end 6 shaped as a quarter circle or other arcuate form and the opposite second end 7 generally square cut or horizontal. The second end 7 has a slot 17 proximate to the back for receiving the gate 21. The gate 21 drops into the slot 17 and the second adjusting bolt 23 advances through a threaded hole in the gate 21. The moveable plate 24 drops in between the plates 16 with ears 22 of the moveable plate 24 resting upon the top edges of the plates 16. The second adjusting bolt 23 then advances from the gate 21 to press the moveable plate 24 firmly against a pier 3 (not shown). The plate 16 is perpendicular to and between the bearing angle 8 and the back plate 14. The vertex of the bearing angle 8 is generally at the midpoint of the plate 16. A lower plate 18 spans the plates 16 co-planar with one leg of the bearing angle 8. A angle 10 joins the lower plate 18 proximate to the second end 7 of the plates 16 and parallels the bearing angle 8. A nut 21 attached to the angle 10 admits the first adjusting bolt 15. The first adjusting bolt 15 has a head upon one end and opposite the head, the first adjusting bolt 15 contacts the pier 3 (not shown). The gusset 9 has a truncated triangular plate shape and extends from the angle 10 to a leg of the bearing angle 8. The gusset 9 is generally centered between the plates 16, and welded to the lower plate 18, the bearing angle 8 and the angle 10. Opposite the bearing angle 8, a back plate 14 spans between a plate 16 and a load transfer plate 12 (not shown) near the first end 6.

Figure 14:
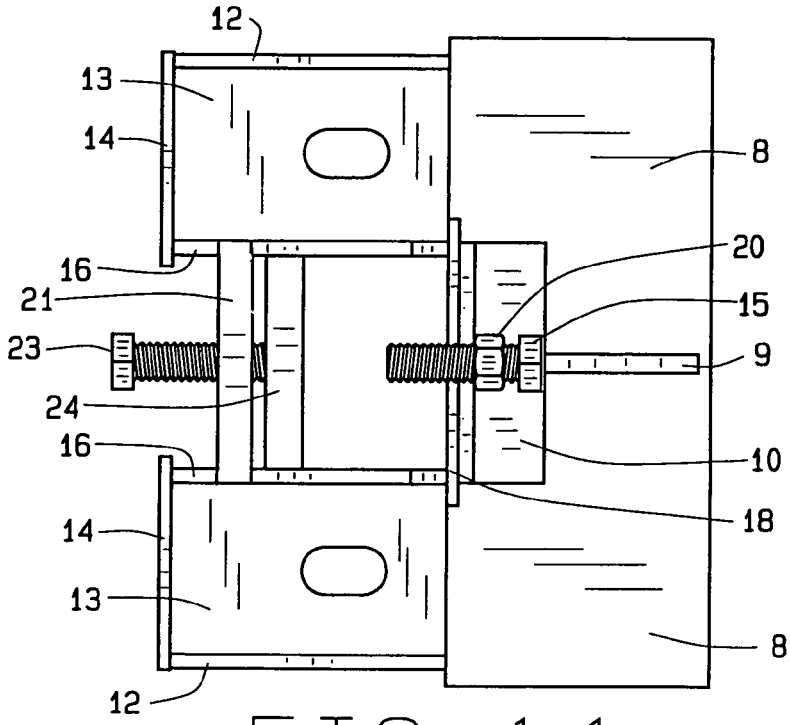
FIG. 14 describes a top view of the third embodiment of the bracket assembly where the moveable plate and bolt contact the pier at two points and prevent translation and rotation of the pier.

Rotating to FIG. 14, the bracket assembly 1 has a symmetric construction that contains a pier 3 between the moveable plate 24 and the first adjusting bolt 15. The plate like gate 21 spans between the parallel and offset plates 16 here shown on edge. The moveable plate 24 advances between the plates 16 under the action of the second adjusting bolt 23. Back plates 14 join perpendicular to the plates 16 and towards the top of the present invention 1. Load transfer plates 12 join perpendicular to the back plates 14 and parallel and spaced apart to the plates 16. The bearing angle 8 joins to both of the load transfer plates 12 and the plates 16. Bottom plates 13 then join between the load transfer plates 12 and the plates 16, and the back plates 14 and the bearing angle 8. The bottom plates 13 have a generally centered hole to admit a support bolt 109 (not shown, but see FIG. 3B).

The bearing angle 8 has a generally centered gusset 9 here shown on edge. The gusset 9 extends down and away from the bearing angle 8 to the angle 10. The angle 10 has an L shaped cross section with one leg of the angle 10 joining the gusset 9 and the other leg of the angle 10 joining the lower plate 18. The lower plate 18 here shown on edge spans across the plates 16 beneath the bearing angle 8. By welding, the gusset 9 joins to the bearing angle 8, angle 10, and the lower plate 18. The lower plate 18 and the other leg of the angle 10 have coaxial holes to admit the first adjusting bolt 15. A nut secures the first adjusting bolt 15 to the bracket assembly 1. The first adjusting bolt 15 in contact with the pier 3 minimizes front to back movement of the pier 3 and rotation of the bracket assembly 1 upon the top of the pier 3.

Figure 15:
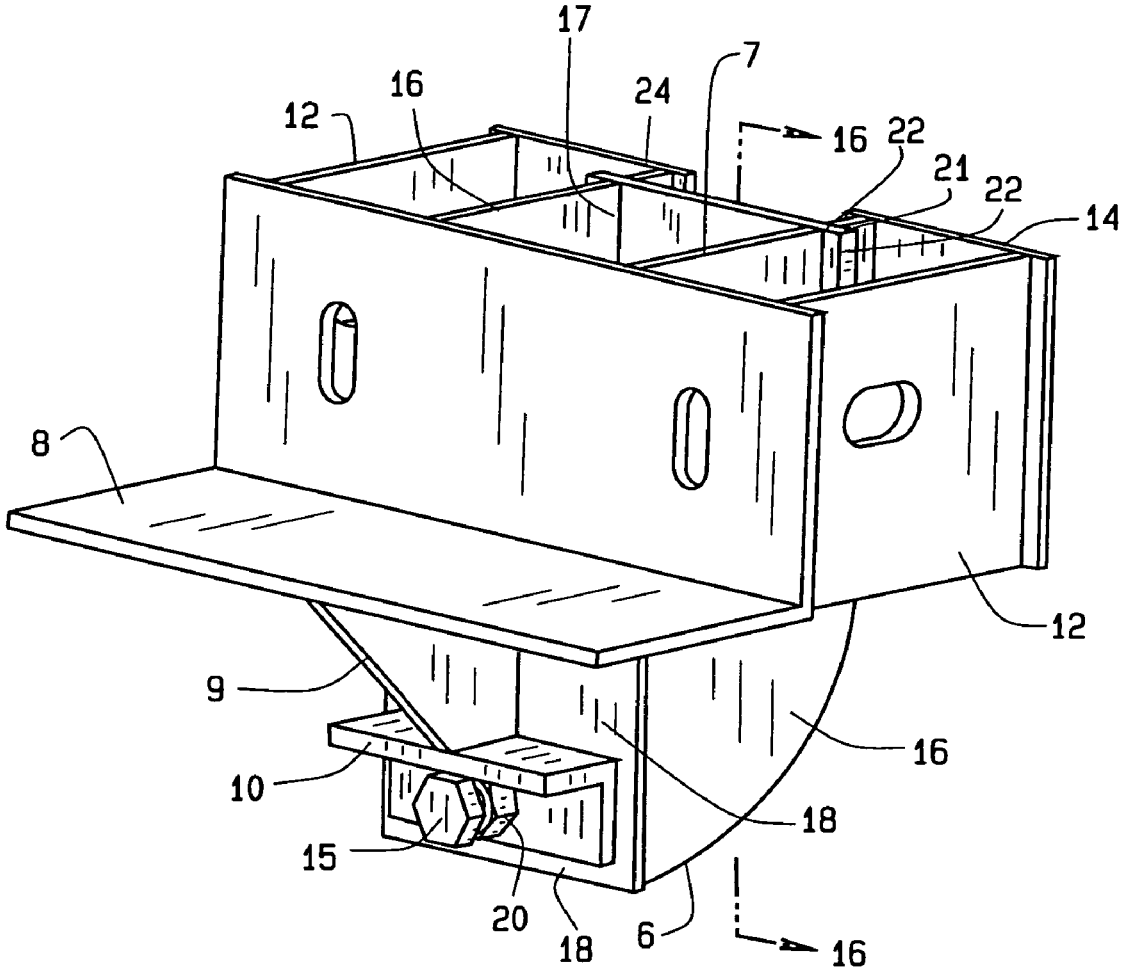
FIG. 15 shows an isometric view of a fourth embodiment of the bracket assembly with a gate in a slotted connection and an adjustable bolt perpendicular to the gate to contain a pier.

The fourth embodiment of the bracket assembly 1 appears in FIG. 15. The bracket assembly 1 begins with two parallel and spaced apart plates 16 as in FIG. 5. A plate 16 has a generally rectangular shape with two ends. The first end 6 has a quarter circle or arcuate shape when viewed from the side of the bracket assembly 1 and the opposite second end 7 has a horizontal or square shape denoting the top of the bracket assembly 1. A bearing angle 8 spans across the plates 16 in an L shaped cross section with the vertex of the L shape generally at the center of the present invention 1. Centered beneath the bearing angle 8, a gusset 9 depends to a lower plate 18. The gusset 9 has a planar shape generally triangular and parallel to the plates 16. The lower plate 18 spans between the plates 16 beneath the bearing angle 8 to the first ends 6. Beneath the gusset 9, a angle 10 spans the lower plate 18. The angle 10 has a generally L shaped cross section with the vertex of the L shape towards the center of the present invention 1. The angle 10 generally parallels the bearing angle 8 and joins by welding to the bearing angle 8, the lower plate 18, and the angle 10. A means to receive a bolt 11, such as a nut 20 centered upon the angle 10, receives an adjusting bolt 15. The adjusting bolt 15 is threaded and has a head. To stabilize the bracket assembly 1 upon the pier 3, the adjusting bolt 15 threads through the nut 20 and passes through both the angle 10 and the lower plate 18 generally centered between the plates 16. The adjusting bolt 15 contacts the pier 3 (not shown).

Spaced apart from and parallel to the plates 16, a pair of load transfer plates 12 extends perpendicular to the bearing angle 8 at the sides of the bracket assembly 1. The load transfer plates 12 have holes generally in the center to receive a pin 107 from the strap 105. Spanning across the plates 16 near the second end 7 and the load transfer plates 12, reinforcing means 14 stiffen the bracket assembly 1, such as back plates 14, parallel to the bearing angle 8. Perpendicular to the bearing angle 8, the load transfer plates 12, and the back plates 14, the bottom plates 13 (see FIG. 17) permit passage of the support bolts 109 and secure nuts to lift the bracket assembly 1 during use as described in FIG. 3B.

Returning to the plates 16 near the second end 7, the plates 16 have slots 17 generally parallel to the length of the pier 3 and proximate towards the back plates 14. Serving as a pier guide, a gate 21 having ears 22 rests within the slots 17 of the two plates 16. The slots 17 have a generally vertical orientation, and a generally rectangular shape. The gate 21 has a generally rectangular shape with two opposite and collinear ears 22. The ears 22 rest upon and extend beyond the slots 17 towards the load transfer plates 12. The gate 21 co-operates with the bearing angle 8 to secure the pier 3 from moving front to back within the bracket assembly 1.

Figure 16:
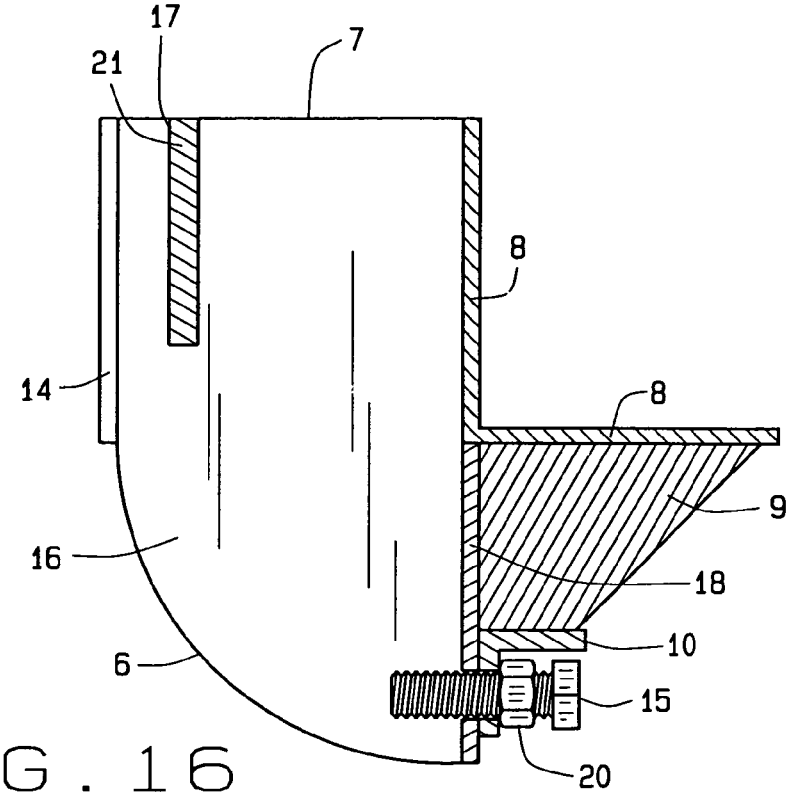
FIG. 16 shows a side view of the fourth embodiment of the bracket assembly with a gate in a slotted connection and an adjustable bolt; and, FIG. 17 describes a bottom view of the fourth embodiment of the bracket assembly where the gate and the adjustable bolt prevent translation and rotation of the pier.

Turning to FIG. 16, a plate 16 has a generally rectangular shape with the first end 6 shaped as a quarter circle or arcuate form and the opposite second end 7 generally square cut or horizontal. The second end 7 has a slot 17 proximate to the back for receiving the gate 21. The plate 16 is perpendicular to and between the bearing angle 8 and the back plate 14. The vertex of the bearing angle 8 is generally at the midpoint of the plate 16. A lower plate 18 spans across the plates 16 co-planar with one leg of the bearing angle 8. An angle 10 joins the lower plate 18 proximate to the second end 7 of the plate 16 and parallels the bearing angle 8. A nut 20 attached to the angle 10 admits the adjusting bolt 15. The adjusting bolt 15 has a head upon one end and opposite the head, the adjusting bolt 15 contacts the pier 3 (not shown). The gusset 9 has a truncated triangular plate shape and extends from the angle 10 to a leg of the bearing angle 8. The gusset 9 is generally centered between the plates 16 and welds to the bearing angle 8, the angle 10, and the lower plate 18. Opposite the bearing angle 8, a back plate 14 spans between a plate 16 and a load transfer plate 12 (not shown) near the first end 6.

Figure 17:
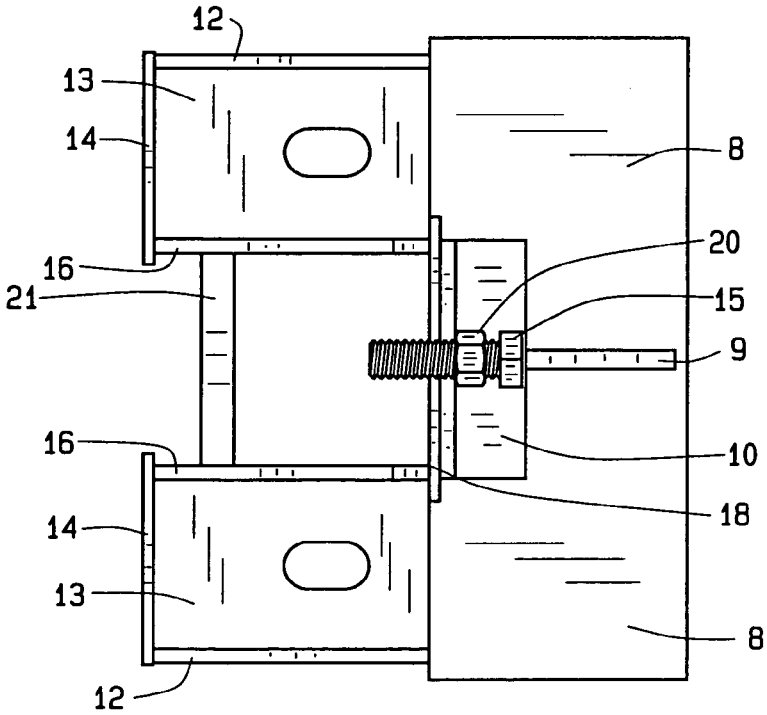

Rotating to FIG. 17, the bracket assembly 1 has a symmetric construction that contains the pier 3 between the gate 21 and the adjusting bolt 15. The rectangular gate 21 spans between the parallel and spaced apart plates 16 here shown on edge. Back plates 14 join perpendicular to the plates 16 and towards the top of the present invention 1. Load transfer plates 12 join perpendicular to the back plates 14 and parallel and spaced apart to the plates 16. The bearing angle 8 joins to both the load transfer plates 12 and the plates 16. Bottom plates 13 then join between the load transfer plates 12 and the plates 16, and the back plates 14 and the bearing angle 8. The bottom plates 13 have a generally centered hole to admit a support bolt 109 (not shown, but see FIG. 3B).

The bearing angle 8 has a generally centered gusset 9 here shown on edge. The gusset 9 extends down and away from the bearing angle 8 to the angle 10. The angle 10 has an L shaped cross section with one leg of the angle 10 joining the gusset 9 and the other leg of the angle 10 joining the lower plate 18. The lower plate 18 spans across the plates 16 beneath the bearing angle 8. The lower plate 18 and the other leg of the angle 10 have coaxial holes to admit the adjusting bolt 15. A nut 20 secures the adjusting bolt 15 to the bracket assembly 1. The adjusting bolt 15 and the gate 21 in contact with the pier 3 minimize front to back movement and rotation of the bracket assembly 1 upon the top of the pier 3.

To utilize the present art, a person holds the plates 16 parallel and spaced apart. The person then welds the bearing angle 8 to the plates 16 with the vertex of the bearing angle 8 towards the center of the invention. Beneath the bearing angle 8, a person welds the lower plate 18 to the plates 16 and the angle 10 to is the lower plate 18. The gusset 9 is then welded perpendicular to a leg of the bearing angle 8 and to the angle 10. Next, the person welds the load transfer plates 12 perpendicular to the ends of the bearing angle 8 and parallel to the plates 16, the back plates 14 upon the plates 16 and the load transfer plates 12, and the bottom plates 13 between the bearing angle 8, the back plates 14, the load transfer plates 12 and the plates 16. With the bracket assembly 1 assembled, a contractor places the preferred embodiment upon a pier 3 as described in FIG. 2. The contractor locates the top of the pier 3 between the plates 16 and at the top edge of the plates 16. With the bracket assembly 1 resting on the top of a pier 3, the contractor places the pin 19 in the slots 17 and then advances the adjusting bolt 15 snug against the pier 3. When using the adjusting bolt 15, the bracket assembly 1 has a proper fit upon the pier 3 when one leg of the bearing angle 8 is parallel to the face of the foundation 2 and the other leg of the bearing angle 8 is beneath and parallel to the foundation 2. After properly fit, the bracket assembly 1 is jacked following FIGS. 3A & 3B to repair a foundation 2.

To use the second embodiment, a person welds the bearing angle 8 to the tube 25 with the vertex of the bearing angle 8 towards the center of the invention. Beneath the bearing angle 8, a person welds the angle 10 to the tube. The gusset 9 is then welded perpendicular to a leg of the bearing angle 8 and to the angle 10. Next, the person welds the load transfer plates 12 perpendicular to the ends of the bearing angle 8 and parallel to the tube, the reinforcing angles 14 upon the tube and the load transfer plates 12, and the bottom plates 13 between the bearing angle 8, the reinforcing angles 14, the load transfer plates 12 and the tube 25. With the bracket assembly 1 assembled, a contractor places the tube 25 over the top of a similarly shaped pier 3 as described in FIG. 2. The contractor locates the top of the pier 3 inside the tube 25 and at the top edge of the tube 25. With the bracket assembly 1 resting on the top of a pier 3, the contractor advances the adjusting bolt 15 snug against the pier 3. When using the adjusting bolt 15, the bracket assembly 1 has a proper fit upon the pier 3 when one leg of the bearing angle 8 is parallel to the face of the foundation 2 and the other leg of the bearing angle 8 is beneath and parallel to the foundation 2. After properly fit, the bracket assembly 1 is jacked following FIGS. 3A & 3B to repair a foundation 2.

To utilize the third embodiment, a person holds the plates 16 parallel and spaced apart. The person then welds the bearing angle 8 to the plates 16 with the vertex of the bearing angle 8 towards the center of the invention. Beneath the bearing angle 8, a person welds the lower plate 18 to the plates 16 and the angle 10 to the lower plate 18. The gusset 9 is then welded perpendicular to a leg of the bearing angle 8 and to the angle 10. Next, the person welds the load transfer plates 12 perpendicular to the ends of the bearing angle 8 and parallel to the plates 16, the back plates 14 upon the plates 16 and the load transfer plates 12, and the bottom plates 13 between the bearing angle 8, the back plates 14, the load transfer plates 12 and the plates 16. With the bracket assembly 1 assembled, a contractor places the preferred embodiment upon a pier 3 as described in FIG. 2. The contractor locates the top of the pier 3 between the plates 16 and at the top edge of the plates 16. With the bracket assembly 1 resting on the top of a pier 3, the contractor places the gate 21 in the slots 17 and the moveable plate 24 between the gate 21 and the bearing angle 8 upon the top edges of the plates 16. The contractor then advances the first adjusting bolt 15 snug against the pier 3 and the second adjusting bolt 23 snug against the moveable plate 24. As before when using the first and second adjusting bolts 15, 23, the bracket assembly 1 has a proper fit upon the pier 3 when one leg of the bearing angle 8 is parallel to the face of the foundation 2 and the other leg of the bearing angle 8 is beneath and parallel to the foundation 2. After properly fit, the bracket assembly 1 is jacked following FIGS. 3A & 3B to repair a foundation 2.

For the fourth embodiment, a person holds the plates 16 parallel and spaced apart. The person then welds the bearing angle 8 to the plates 16 with the vertex of the bearing angle 8 towards the center of the invention. Beneath the bearing angle 8, a person welds the lower plate 18 to the plates 16 and the angle 10 to the lower plate 18. The gusset 9 is then welded perpendicular to a leg of the bearing angle 8 and to the angle 10. Next, the person welds the load transfer plates 12 perpendicular to the ends of the bearing angle 8 and parallel to the plates 16, the back plates 14 upon the plates 16 and the load transfer plates 12, and the bottom plates 13 between the bearing angle 8, the back plates 14, the load transfer plates 12 and the plates 16. With the bracket assembly 1 assembled, a contractor places the preferred embodiment upon a pier 3 as described in FIG. 2. The contractor locates the top of the pier 3 between the plates 16 and at the top edge of the plates 16. With the bracket assembly 1 resting on the top of a pier 3, the contractor places the gate 21 within the plates 16 and the ears 22 in the slots 17 and then advances the adjusting bolt 15 snug against the pier 3. When using the adjusting bolt 15, the bracket assembly 1 has a proper fit upon the pier 3 when one leg of the bearing angle 8 is parallel to the face of the foundation 2 and the other leg of the bearing angle 8 is beneath and parallel to the foundation 2. After properly fit, the bracket assembly 1 is jacked following FIGS. 3A & 3B to repair a foundation 2.

From the aforementioned description, a bracket assembly for lifting and supporting a foundation has been described. The bracket assembly is uniquely capable of decreasing moment upon a bracket with an adjusting bolt. The bracket assembly and its various components may be manufactured from many materials including but not limited to structural steel sections, welded steel plates, polymers, high density polyethylene, polypropylene, polyvinyl chloride, nylon, ferrous and non-ferrous metals, their alloys, and composites.

We claim:

1. A bracket assembly for lifting and supporting a foundation, said bracket assembly rests upon a pier adjacent to a foundation and a separate secondary component supports said bracket assembly and drives said pier into the ground, wherein the improvement comprises:

a housing to contain said pier, having a first end denoting the lower end of said housing and an opposite second end denoting the upper end of said housing;

a bearing member joined to said housing and adapted to grasp said foundation;

at least one gusset beneath and joined to said bearing member, said gusset joining a lower plate contiguous with said housing;

a pair of load transfer plates flanking said housing, said load transfer plates adapted to be secured to said secondary component;

a pair of bottom plates proximate to said housing and said load transfer plates, said bottom plates adapted to be secured to said secondary component;

a means to reinforce said bracket assembly opposite and parallel to said bearing member; and, at least one adjusting bolt having a threaded connection to said lower plate and contacting said pier beneath said bearing member, and said first adjusting bolt in cooperation with said housing restraining said pier from translation within said housing, restraining said housing from rotation upon said pier, and preventing translation of said pier relative to said foundation.

2. The bracket assembly of claim 1 further comprising:

said housing having two parallel and spaced apart plates, said plates having a generally rectangular shape and a slot formed into the upper end of each plate; and, said lower plate spanning said plates beneath said bearing member and behind said gusset and admitting at least one adjusting bolt therethrough.

3. The bracket assembly of claim 2 further comprising:

a cylindrical pin being positioned within said slots of said plates and spanning between said plates thereby holding said pier between said pin and said first adjusting bolt.

4. The bracket assembly of claim 3 further comprising:

said slots, upon each plate, having an orientation to resist dislodging of said pin as said secondary component lifts said bracket assembly and drives said pier into the ground.

5. The bracket assembly of claim 2 further comprising:

a gate having two parallel and opposite ears, resting within said slots of said plates;

a second adjusting bolt advancing through said gate; and, a moveable plate with two parallel and opposite ears resting between said plates, said ears sliding upon the upper ends of said plates, said second adjusting bolt contacting said moveable plate, and turning said second adjusting bolt advances said moveable plate against said pier.

6. The bracket assembly of claim 2 further comprising:

a gate having two parallel and opposite ears resting within said slots of said plates and spanning between said plates.

7. The bracket assembly of claim 2 wherein said bearing member is one of plates or angle shaped members.

8. The bracket assembly of claim 2 wherein said reinforcing means is one of plates, angle shaped members, or a channel shaped member.

9. The bracket assembly of claim 1 further comprising:

said housing having a hollow tube adapted to receive a pier of complementary cross section; and, said bolt receiving means being threaded holes in said lower plate and said tube.

10. The bracket assembly of claim 9 wherein said bearing member is one of plates or angle shaped members.

11. The bracket assembly of claim 10 wherein said reinforcing means is one of angle shaped members, plates, or a channel shaped member.

12. A bracket assembly for lifting and supporting a foundation, said bracket assembly rests upon a pier adjacent to a foundation and a separate secondary component elevates said bracket assembly relative to said pier, said bracket assembly having a housing to contain said pier with a first end denoting the lower end of said housing and an opposite second end denoting the upper end of said housing, a bearing member attached to said housing proximate to said second end and adapted to grasp said foundation, a gusset beneath and joined perpendicular to said bearing member and a lower plate, a pair of load transfer plates flanking said housing and in contact with said secondary component, a pair of bottom plates proximate to said housing and said load transfer plates and in contact with said secondary component, wherein the improvement comprises:

at least one adjusting bolt threadedly connected to said lower plate and contacting said pier beneath said bearing member, and said at least one adjusting bolt in cooperation with said housing restraining said pier from translation within said housing, restraining said housing from rotation upon said pier, and preventing translation of said pier relative to said foundation;

said housing having two parallel and spaced apart plates having a generally rectangular shape, a first end denoting the lower end of said plate and an opposite second end denoting the upper end of said plate, said second end having a slot, and said lower plate spanning said plates beneath said bearing member and behind said gusset; and, a means to reinforce said bracket assembly opposite and parallel to said bearing member.

13. The bracket assembly of claim 12 further comprising:

a cylindrical pin being positioned within said slots of said plates and spanning between said plates.

14. The bracket assembly of claim 13 further comprising:

said slot having an orientation to resist dislodging said pin during lifting by said secondary component.

15. The bracket assembly of claim 12 further comprising:

a gate having two parallel and opposite ears, resting within the slots of said plates; a second adjusting bolt advancing through said gate; and, a moveable plate having two parallel and opposite ears resting between said plates, said ears sliding upon said second end of said plates, and said second adjusting bolt contacting said moveable plate; thus, turning said second adjusting bolt advances said moveable plate against said pier.

16. The bracket assembly of claim 12 further comprising:

a gate having two parallel and opposite ears resting within said slots of said plates and spanning between said plates.

17. The bracket assembly of claim 12 wherein said reinforcing means is one of angle shaped members, plates, or a channel shaped member.

18. A bracket assembly for lifting and supporting a foundation, said bracket assembly rests upon a pier adjacent to a foundation and a separate secondary component elevates said bracket assembly relative to said pier, including a housing having an upper end and an opposite lower end, wherein the improvement comprises:

two or more slots in said upper end of said housing;

at least one adjusting bolt proximate to said lower end of said housing and contacting said pier; thus said slots, said securing means, and said adjusting bolt preventing translation and rotation of said housing relative to said pier during lifting by said secondary component; and, means to secure said pier relative to said slots wherein said securing means is one of a gate alone, or a gate in combination with a moveable plate upon a second adjusting bolt threaded through said gate.

* * * * *